US005715739A

United States Patent [19]

White

[11] Patent Number: 5,715,739

[45] Date of Patent: Feb. 10, 1998

[54] BULLET TRAP SYSTEM

[76] Inventor: Robert M. White, 1531 E. Superior St., Duluth, Minn. 55812

[21] Appl. No.: 804,066

[22] Filed: Feb. 21, 1997

[51] Int. Cl.[6] ..... F41J 1/14

[52] U.S. Cl. ..... 89/36.02; 273/410; 273/404; 273/407

[58] Field of Search ..... 89/36.02, 36.15; 273/404, 407, 410, 398, 400, 401, 402, 403, 408, 394

[56] References Cited

U.S. PATENT DOCUMENTS

| | | | |
|---|---|---|---|
| 1,844,581 | 2/1932 | Koehler | 273/410 |
| 2,013,133 | 9/1935 | Caswell . | |
| 4,126,311 | 11/1978 | Wagoner | 273/410 |
| 4,201,385 | 5/1980 | Szabados | 273/410 |
| 4,588,194 | 5/1986 | Steidle et al. | 273/410 |
| 4,917,388 | 4/1990 | Marquardt | 273/407 |
| 5,486,008 | 1/1996 | Coburn | 273/410 |

FOREIGN PATENT DOCUMENTS

| | | | |
|---|---|---|---|
| 2539640 | 7/1984 | France | 273/404 |
| 214433 | 10/1984 | German Dem. Rep. | 273/410 |
| 213925 | 3/1941 | Switzerland | 273/407 |

*Primary Examiner*—Stephen M. Johnson

[57] ABSTRACT

A new Bullet Trap System for allowing a user to perform target practice with a gun without fear of the bullets straying and injuring another person or property. The inventive device includes a funnel device having an enlarged end and a narrow end, a storage container is attached to the narrow end, and a support stand securing the funnel device. The enlarged end receives the bullet from the gun whereafter the bullet engages a slanted wall of the funnel device thereby slowing the travel of the bullet. The bullet thereafter projects into the storage container through the narrow end where the user may empty upon filling with the bullets.

15 Claims, 3 Drawing Sheets

FIG 1
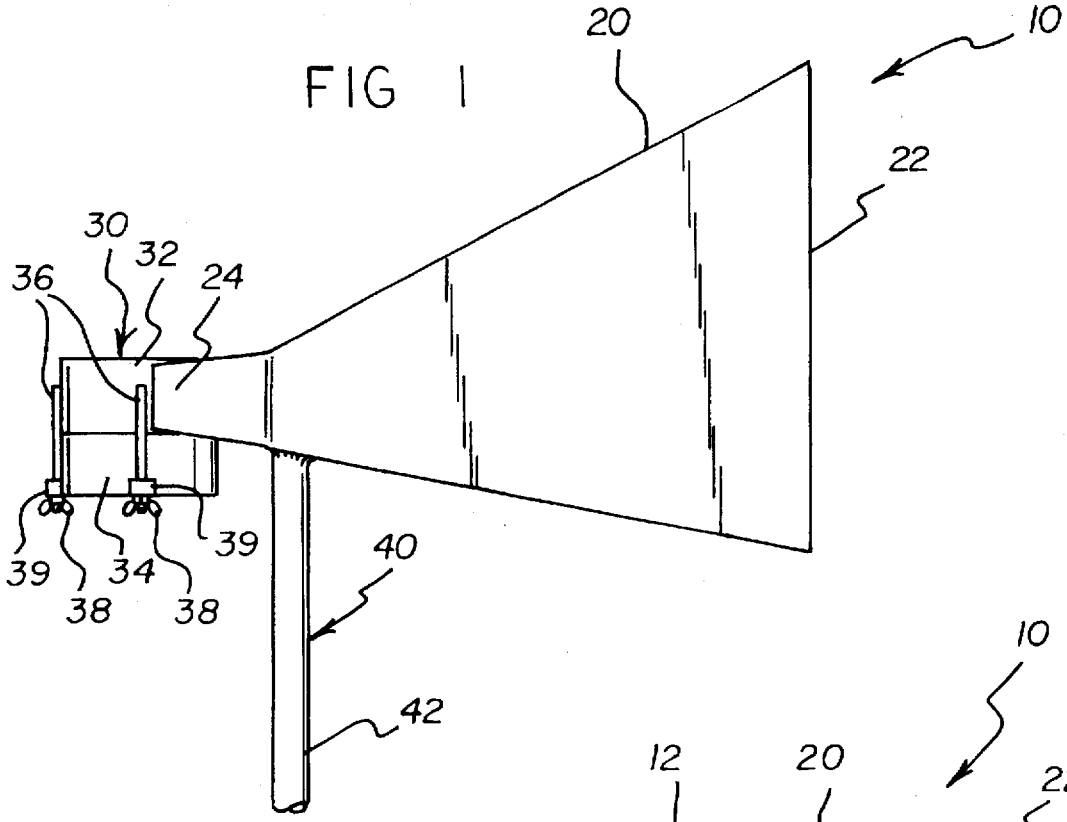
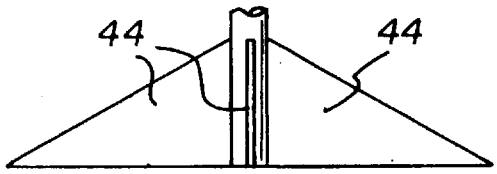
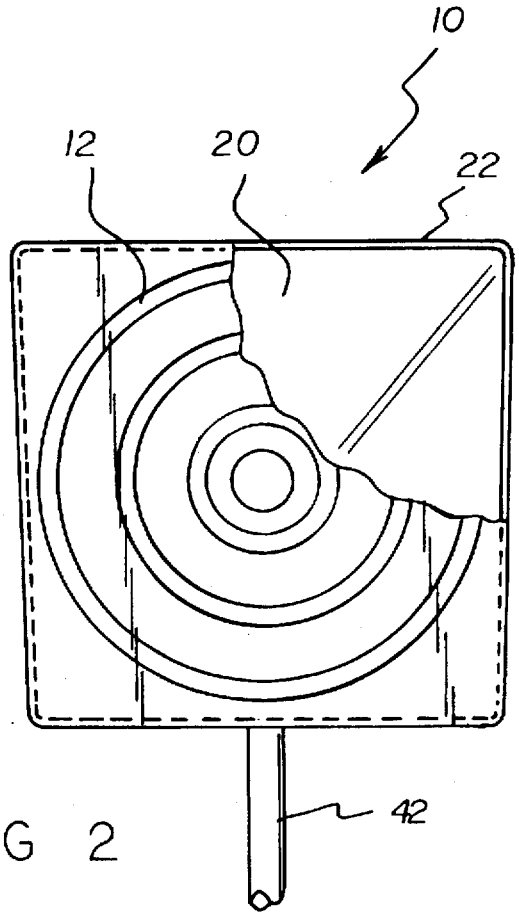
FIG 2

FIG 3
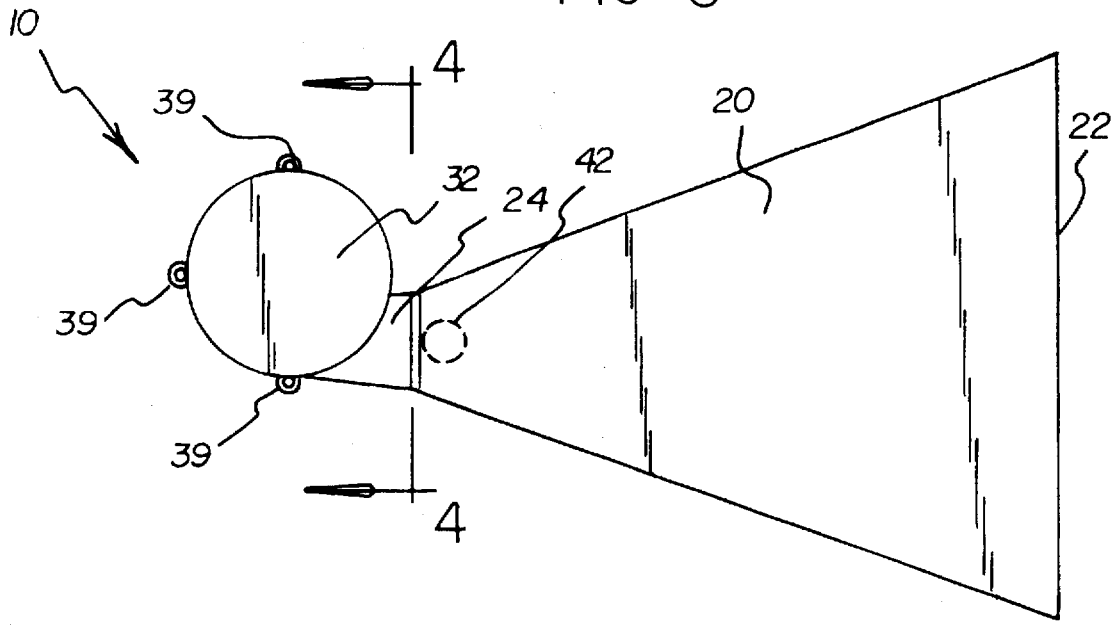
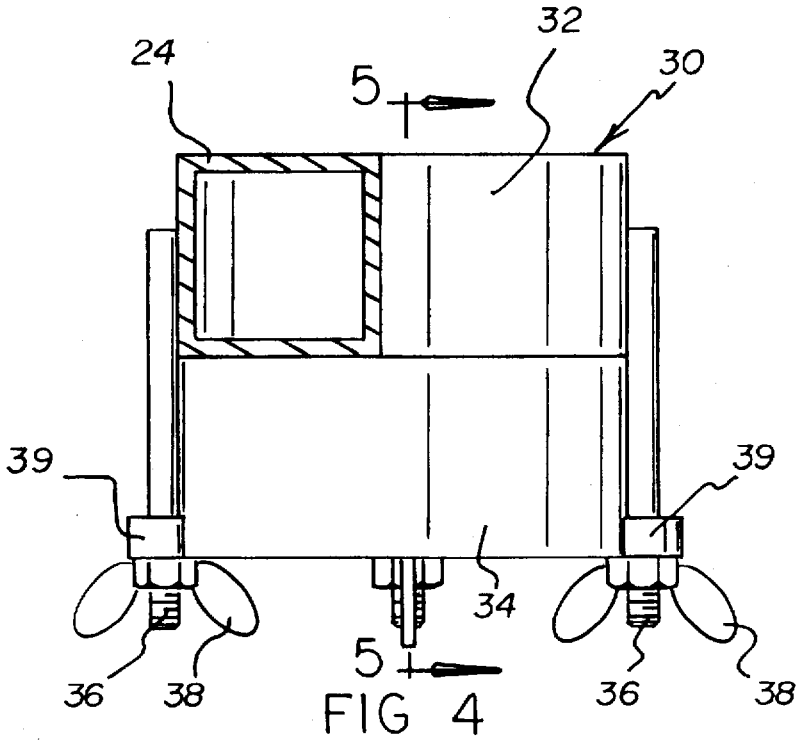
FIG 4

FIG 5
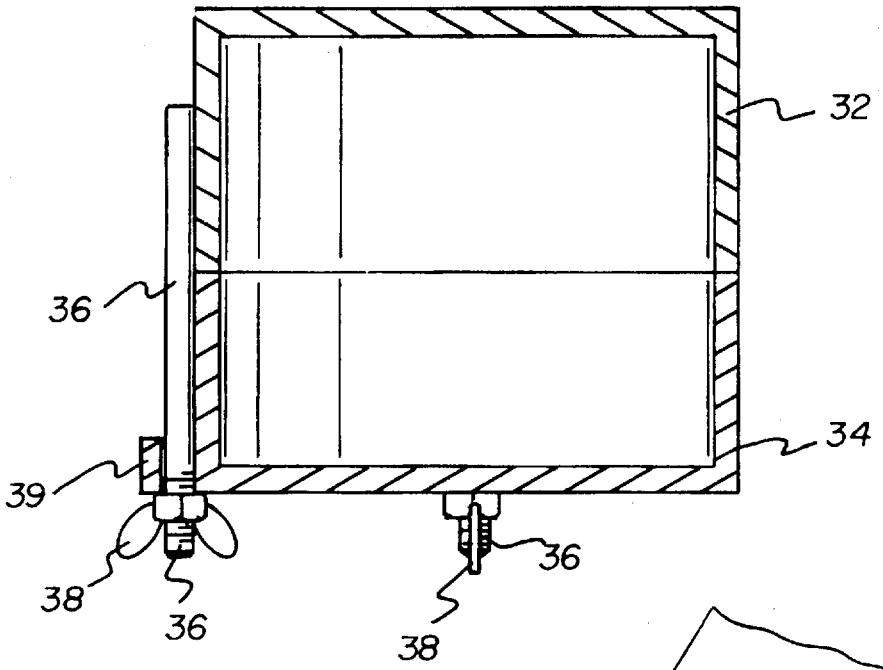
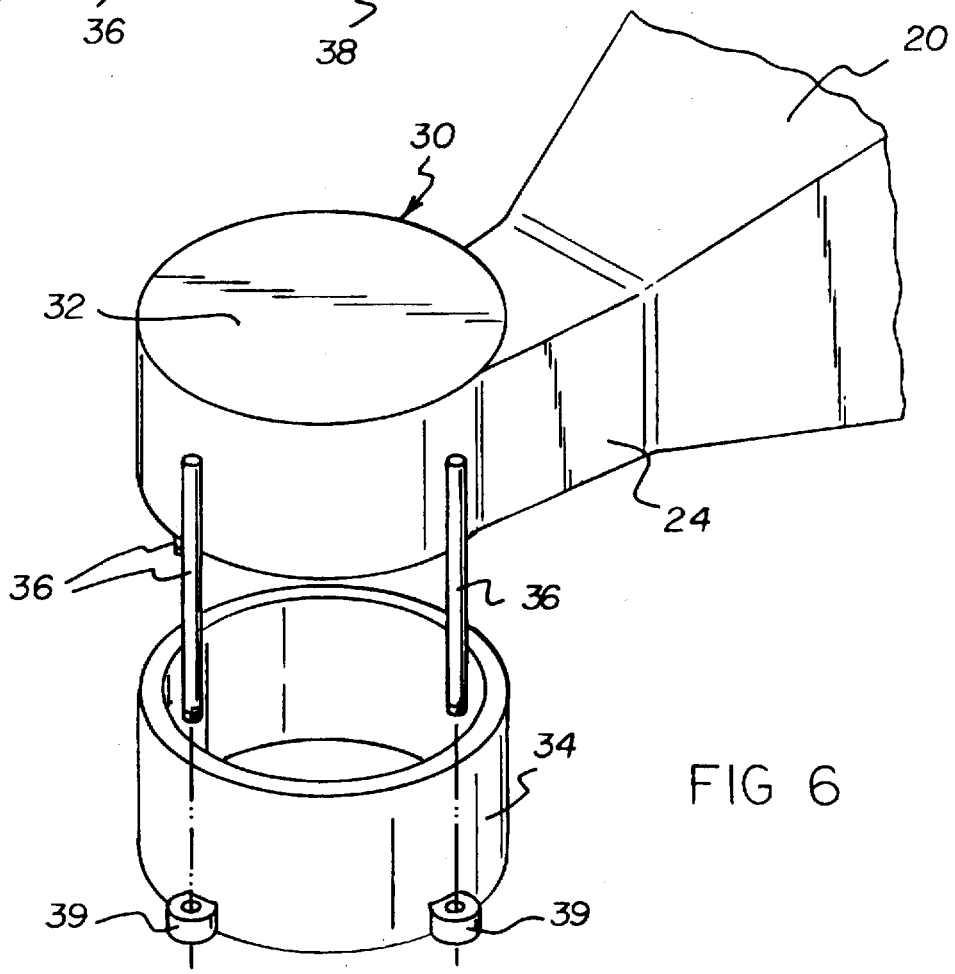
FIG 6

BULLET TRAP SYSTEM

BACKGROUND OF THE INVENTION

1. Field of the Invention

The present invention relates to Bullet Trapping Devices and more particularly pertains to a new Bullet Trap System for allowing a user to perform target practice with a gun without fear of the bullets straying and injuring another person or property.

2. Description of the Prior Art

The use of Bullet Trapping Devices is known in the prior art. More specifically, Bullet Trapping Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Bullet Trapping Devices include U.S. Pat. No. 5,259,291; U.S. Pat. No. 4,821,620; U.S. Design Patent 342,302; U.S. Pat. No. 4,118,807; U.S. Pat. No. 4,470,604 and U.S. Pat. No. 4,126,311.

While these devices fulfill their respective, particular objectives and requirements, the aforementioned patents do not disclose a new Bullet Trap System. The inventive device includes a funnel device having an enlarged end and a narrow end, a storage container is attached to the narrow end, and a support stand securing the funnel device.

In these respects, the Bullet Trap System according to the present invention substantially departs from the conventional concepts and designs of the prior art, and in so doing provides an apparatus primarily developed for the purpose of allowing a user to perform target practice with a gun without fear of the bullets straying and injuring another person or property.

SUMMARY OF THE INVENTION

In view of the foregoing disadvantages inherent in the known types of Bullet Trapping Devices now present in the prior art, the present invention provides a new Bullet Trap System construction wherein the same can be utilized for allowing a user to perform target practice with a gun without fear of the bullets straying and injuring another person or property.

The general purpose of the present invention, which will be described subsequently in greater detail, is to provide a new Bullet Trap System apparatus and method which has many of the advantages of the Bullet Trapping Devices mentioned heretofore and many novel features that result in a new Bullet Trap System which is not anticipated, rendered obvious, suggested, or even implied by any of the prior art Bullet Trapping Devices, either alone or in any combination thereof.

To attain this, the present invention generally comprises a funnel device having an enlarged end and a narrow end, a storage container is attached to the narrow end, and a support stand securing the funnel device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Bullet Trap System apparatus and method which has many of the advantages of the Bullet Trapping Devices mentioned heretofore and many novel features that result in a new Bullet Trap System which is not anticipated, rendered obvious, suggested, or even implied by any of the prior art Bullet Trapping Devices, either alone or in any combination thereof.

It is another object of the present invention to provide a new Bullet Trap System which may be easily and efficiently manufactured and marketed.

It is a further object of the present invention to provide a new Bullet Trap System which is of a durable and reliable construction.

An even further object of the present invention is to provide a new Bullet Trap System which is susceptible of a low cost of manufacture with regard to both materials and labor, and which accordingly is then susceptible of low prices of sale to the consuming public, thereby making such Bullet Trap System economically available to the buying public.

Still yet another object of the present invention is to provide a new Bullet Trap System which provides in the apparatuses and methods of the prior art some of the advantages thereof, while simultaneously overcoming some of the disadvantages normally associated therewith.

Still another object of the present invention is to provide a new Bullet Trap System for allowing a user to perform target practice with a gun without fear of the bullets straying and injuring another person or property.

Yet another object of the present invention is to provide a new Bullet Trap System which includes a funnel device having an enlarged end and a narrow end, a storage container is attached to the narrow end, and a support stand securing the funnel device.

Still yet another object of the present invention is to provide a new Bullet Trap System that prevents ricocheting of the bullets shot from a gun.

Even still another object of the present invention is to provide a new Bullet Trap System that retains the bullets within one convenient storage device thereby preventing wild animals from consuming the lead portion of the bullets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new Bullet Trap System according to the present invention.

FIG. 2 is a front view of the present invention.

FIG. 3 is a top view of the present invention.

FIG. 4 is a cross sectional view taken along line 4—4 of FIG. 3.

FIG. 5 is a cross sectional view taken along line 5—5 of FIG. 4.

FIG. 6 is an exploded upper perspective view of the present invention.

DESCRIPTION OF THE PREFERRED EMBODIMENT

With reference now to the drawings, and in particular to FIGS. 1 through 6 thereof, a new Bullet Trap System embodying the principles and concepts of the present invention and generally designated by the reference numeral 10 will be described.

More specifically, it will be noted that the Bullet Trap System 10 comprises a funnel device 20 having an enlarged end 22 and a narrow end 24, wherein the enlarged end 22 is for receiving a bullet shot from a gun. A storage container 30 is attached to the narrow end 24 of the funnel device 20 for stopping and storing the bullet. An optional target sheet 12 is securable to the enlarged end 22 for allowing a user to aim for. A support stand 40 secures the funnel device 20 for supporting the funnel device 20 at a desired elevation for shooting at with the gun. The funnel device 20 preferably has a rectangular cross section tapering from the enlarged end 22 to the narrow end 24. The funnel device 20 and the storage container 30 are comprised of a rigid metal resistant to the impact of the bullet.

As shown in FIGS. 1, 3, 4, 5 and 6 of the drawings, the storage container 30 comprises an upper portion 32 and a lower portion 34 formed to closely engage the upper portion 32 forming an interior cavity. The interior cavity captures and retains the bullets after they travel into the funnel device. A plurality of threaded rods 36 are secured to the upper portion 32 parallel to a longitudinal axis of the upper portion 32 and projecting toward the lower portion 34. A plurality of eyelets 39 are secured to the lower portion 34 for receiving the plurality of threaded rods 36. A plurality of wing nuts 38 are provided for threadably engaging the plurality of threaded rods 36 for retaining the lower portion 34 juxtaposed to the upper portion 32 during operation. The storage container 30 is preferably cylindrical shaped as shown in FIGS. 3 and 6 of the drawings. The narrow end 24 of the funnel device 20 is attached to the upper portion 32 of the storage container 30 projecting a finite distance from the longitudinal axis of the upper portion 32.

As shown in FIGS. 1 and 2 of the drawings, the support stand 40 comprises a support rod 42 having an upper end and a lower end. The upper end of the support rod 42 secures the funnel device 20 as shown in FIG. 1. A plurality of syncline legs 44 are secured to the lower end of the support rod 42 orthogonally for supporting the support rod 42 vertically.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bullet trap system comprising:

a funnel device having an enlarged end and a narrow end, wherein said enlarged end is for receiving a bullet shot from a gun; and a storage container attached to said narrow end of said funnel device for stopping and storing said bullet, said storage container having a cylindrical shape with upper and lower substantially flat sides for being oriented in horizontal planes, said storage container being split into an upper portion and a lower portion along a substantially horizontal plane, said upper portion being in communication with the narrow end of said funnel device, said lower portion being located below said upper portion to receive bullets entering said upper portion from said funnel device, said lower portion being removably mounted to said upper portion such that said lower portion may be removed from said upper portion and funnel device for removing spent bullets from said storage container.

2. The bullet trap system of claim 1, including a support stand secured to said funnel device for supporting said funnel device at a desired elevation.

3. The bullet trap system of claim 2, wherein said support stand comprises:

a support rod having an upper end and a lower end, wherein said upper end is secured to said funnel device; and a plurality of substantially triangular shaped legs secured in a radially extending relationship to said lower end of said support rod for supporting said support rod in a vertical orientation.

4. The bullet trap system of claim 1, wherein said storage container comprises:

a plurality of threaded rods secured to said upper portion parallel to a longitudinal axis of the cylindrical shape of said upper portion and projecting toward said lower portion;

a plurality of eyelets secured to said lower portion for receiving said plurality of threaded rods; and a plurality of wing nuts for threadably engaging said plurality of threaded rods for mounting said lower portion to said upper portion.

5. The bullet trap system of claim 1, wherein the narrow end of said funnel device is oriented tangential to the cylindrical shape of said storage container.

6. The bullet trap system of claim 1, including a target sheet securable to the enlarged end of said funnel device.

7. The bullet trap system of claim 1, wherein said funnel device has a rectangular cross section tapering from said enlarged end to said narrow end.

8. The bullet trap system of claim 1, wherein said funnel device and said storage container are comprised of a rigid metal.

9. A bullet trap system comprising:

a funnel device having an enlarged end and a narrow end, a storage container attached to said narrow end of said funnel device for stopping and storing said bullet; and a support stand securing said funnel device for supporting said funnel device at a desired elevation;

wherein said storage container comprises:

an upper portion;

a lower portion formed to closely engage said upper portion forming an interior cavity;

a plurality of threaded rods secured to said upper portion parallel to a longitudinal axis of said upper portion and projecting toward said lower portion;

a plurality of eyelets secured to said lower portion for receiving said plurality of threaded rods; and a plurality of wing nuts for threadably engaging said plurality of threaded rods for retaining said lower portion juxtaposed to said upper portion during operation.

10. The bullet trap system of claim 9, wherein said storage container is cylindrical shaped.

11. The bullet trap system of claim 9, including a target sheet securable to said enlarged end.

12. The bullet trap system of claim 9, wherein said support stand comprises:

a support rod having an upper end and a lower end, wherein said upper end secures said funnel device; and a plurality of syncline legs secured to said lower end of said support rod orthogonally for supporting said support rod vertically.

13. The bullet trap system of claim 9, wherein said funnel device has a rectangular cross section tapering from said enlarged end to said narrow end.

14. The bullet trap system of claim 9, wherein said narrow end of said funnel device is attached to said upper portion of said storage container projecting a finite distance from said longitudinal axis of said upper portion.

15. The bullet trap system of claim 9, wherein said funnel device and said storage container are comprised of a rigid metal.

* * * * *